United States Patent [19]

Leahy

[11] Patent Number: 4,828,502

[45] Date of Patent: May 9, 1989

[54] CONVERTIBLE DRY WIPE BOARD

[75] Inventor: David J. Leahy, Framingham, Mass.

[73] Assignee: Dennison Manufacturing Company, Framingham, Mass.

[21] Appl. No.: 157,754

[22] Filed: Feb. 19, 1988

[51] Int. Cl.[4] ..... B43L 1/06

[52] U.S. Cl. ..... 434/416; 434/421

[58] Field of Search ..... 434/408, 413, 414, 416, 434/419, 420, 421, 428

[56] References Cited

U.S. PATENT DOCUMENTS

| | | | |
|---|---|---|---|
| 332,050 | 12/1885 | Carter | 434/416 X |
| 2,092,323 | 9/1937 | Myers | 434/421 X |
| 2,655,740 | 10/1953 | Goodrich | 434/414 |
| 2,971,277 | 2/1961 | Vaillancourt | 434/417 |

FOREIGN PATENT DOCUMENTS

| | | | |
|---|---|---|---|
| 1272106 | 8/1961 | France | 434/421 |
| 1450281 | 9/1976 | United Kingdom | 434/408 |

*Primary Examiner*—William H. Grieb
*Attorney, Agent, or Firm*—Barry D. Josephs

[57] ABSTRACT

A dry wipe marking board which is wall mountable and convertible to display a picture or painting while concealing the writing panel. The convertible dry wipe board is composed of a wall mountable support panel to which is secured a foldable dry wipe writing panel. When not in use the board may be folded along a hinge line to completely conceal the writing panel and display in its place a picture or painting which has been secured to the backside of the support structure. The conversion can be accomplished without removing the dry wipe board from its hanging position on a wall surface and without removing any component from the hanging structure. The dry wipe writing panel itself is preferably composed of a white pigmented polypropylene panel which is used for marking or writing thereon with conventional dry wipe marking instruments.

11 Claims, 4 Drawing Sheets

CONVERTIBLE DRY WIPE BOARD

BACKGROUND OF THE INVENTION

1. Field of the Invention

The present invention relates to a wall mounted dry wipe board which is foldable and convertible into a picture display while concealing the dry wipe writing surface. The present invention relates to a foldable wall mounted writing surface for use with dry wipe markers.

2. Description of the Prior Art

The prior art discloses blackboard panels which are designed to be wall mounted and which have attached thereto additional panels which can be removed or doors which can be closed to conceal the blackboard prior to use.

In U.S. Pat. No. 2,655,740 a wall mountable blackboard is disclosed having two additional door-like panels attached to the hanging panel. The doors have additional blackboard writing panels attached to their inside surface so that when the doors are open the total blackboard writing surface is increased two fold. When the doors are closed the blackboard surface is concealed from view and the wall mounted structure appears as a neatly closed cabinet. The principal objective of the wall mounted blackboard disclosed in this reference is to increase the available surface area of the blackboard without requiring any additional wall space. Another objective is to provide a wall mountable blackboard which may be concealed from view by means of closable doors attached to each end of the blackboard.

In U.S. Pat. No. 2,971,277 another type of wall mountable concealable blackboard is disclosed. This reference discloses a wall mountable blackboard structure which includes a frame having a slot or opening to received a picture display panel which can be slid through the slot thus covering the blackboard. When it is desired to use the blackboard, the picture display panel is removed from the slot. This type of concealable blackboard has the disadvantage that one must remove the picture display to use blackboard and then must replace the picture panel over blackboard to conceal the blackboard when it is not in use.

SUMMARY OF THE INVENTION

The convertible dry wipe board of the present invention has the feature that in the open position it functions as a dry wipe board for marking and writing using conventional dry wipe markers, and in the closed position it displays a picture or painting while concealing the writing surface. The convertible board is secured to a wall surface using conventional picture hooks or bolts. The convertible board is an assembly composed of a support structure and a dry wipe writing panel which is superimposed over and secured to the support structure. The support structure is composed of a left support panel and a right support panel. The left support panel is connected to the right support panel by a upper and lower hinge connection defining a hinge line so that the support panel can be open and closed along the hinge line. The dry wipe writing panel is secured over the left and right support panels to form the convertible dry wipe board.

The left support panel is formed of an outer frame, an inner border, and a lattice web structure. The outer frame and inner border surround the lattice web structure. The left support structure is formed by molding a thermoplastic resin preferably ABS (acrylonitrile-butadiene-styrene) resin to produce a one piece construction. Similarly the right support panel is likewise composed of an outer frame and inner border and a lattice web structure. The outer frame and inner border surround the lattice web structure. The right support panel is also manufactured by molding a thermoplastic material, preferably an ABS resin, to produce the right panel in a one piece structure. The left and right support panels are joined together so they can be opened and closed along a hinge line.

A writing panel preferably composed of polypropylene is superimposed over the left and right support panels and is secured to the support panel by a suitable adhesive. The writing panel is preferably composed of polypropylene with a white pigment such as titanium dioxide dispersed therein to give the writing panel a white appearance. The writing panel has a smooth writing surface and is just thick enough that it provides a rigid writing surface when it is laid on top of the lattice web structure of the support panel. The writing panel is sufficiently thick that it will not warp or be penetrated by the pressure of affelt or plastic tip marking instrument. The writing panel composed of polypropylene is preferably on a fold line along its width and substantially or nearly coincident with the hinge line separating the left and right support panels. The writing panel has the property that it may be folded along its fold line many thousands of times without causing tearing of the writing panel. The convertible dry wipe board assembly includes a lock preferably at the top and bottom of the board to keep the writing panel in a locked open position when it is desired to write on it. Conventional dry wipe marker pens may be used to write on the board when it is in the open position. These pens typically have a felt or plastic tip and employ a solvent based ink which dries to a powder after it is applied to the surface of the smooth writing panel. The dried ink may subsequently be erased using a cloth or felt eraser.

After use of the writing panel the dry wipe board assembly may be closed while still hanging on a wall surface without removing any component of the assembly from the wall. When the dry wipe board is closed it is converted into a picture or painting display which completely hides the dry wipe panel. Thus, in the closed position only the picture or painting is in view and one would never know that the picture display could be instantly converted into a dry wipe writing surface by simply opening the support panel to which the picture is secured. The picture itself is secured to the backside of one of the support panels (left or right) so that when the support panels are in the open position and the dry wipe writing panel is displayed the picture is hidden from view.

The present dry wipe board assembly has the advantage that it is easily constructed and converts readily from a dry wipe board to a picture or painting display which completely hides the writing panel. The invention has the additional advantage that it is composed of inexpensive materials and utilizes effectively the living hinge property of polypropylene which enables the user to open and close the writing panel many thousands of times without causing any tear or deterioration along the fold line therein.

DETAILED DESCRIPTION

Figure 1:
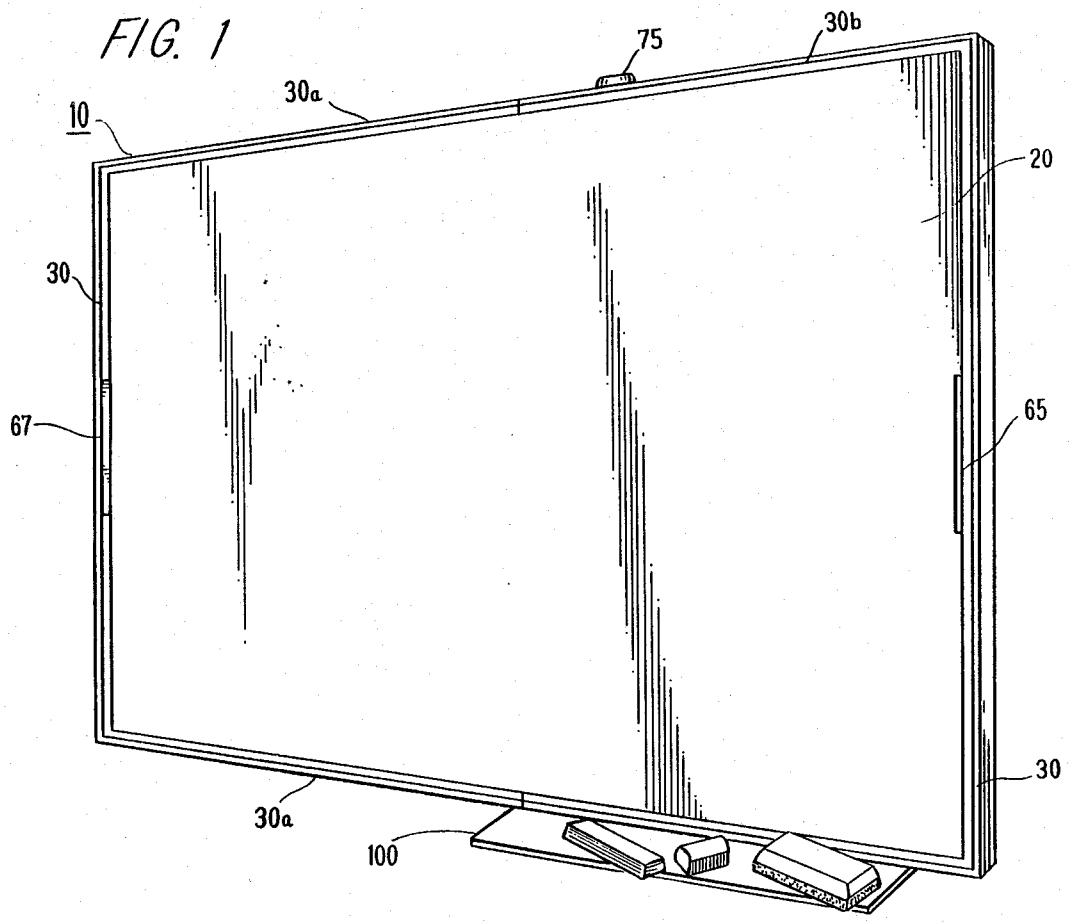
FIG. 1 is a pictorial view of the dry wipe board assembly in the open position exposing the dry wipe panel for writing or marking thereon.
Figure 2:
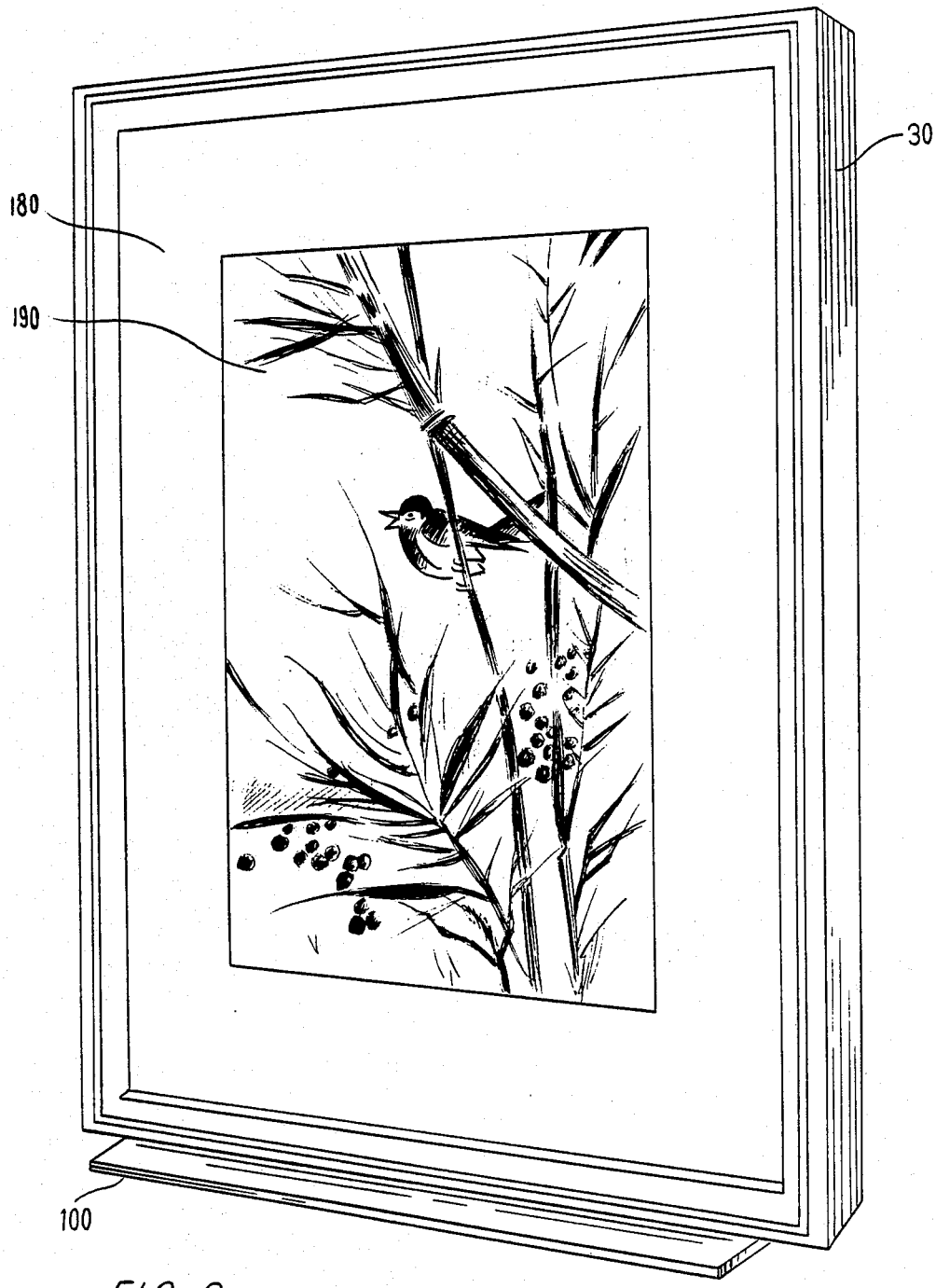
FIG. 2 is a pictorial view of the convertible dry wipe board in the closed position displaying a picture while concealing the dry wipe panel.
Figure 3:
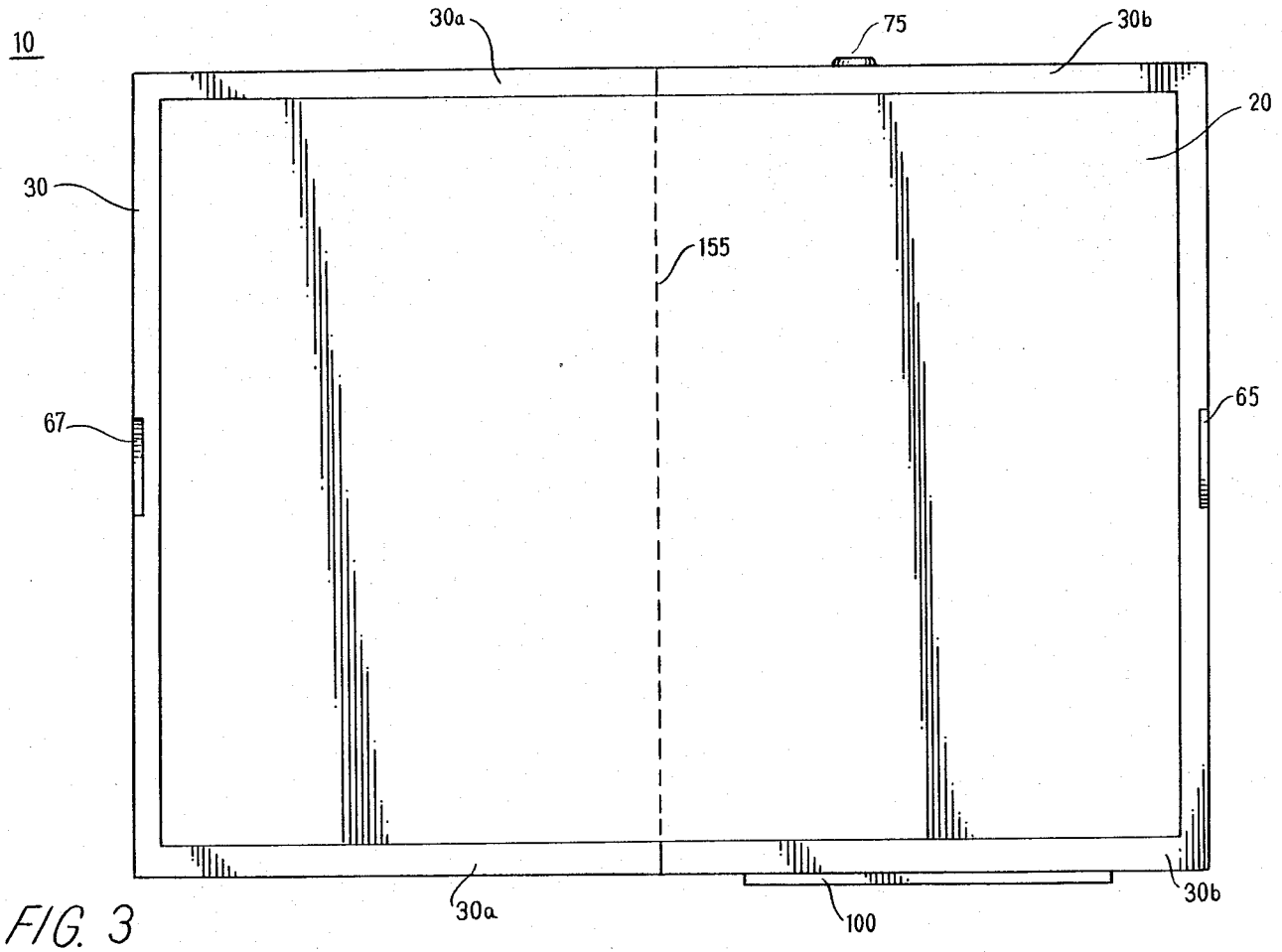
FIG. 3 is a plan view of the convertible dry wipe board in the open position with the writing panel exposed.

A preferred embodiment of the convertible dry wipe board of the invention is illustrated in FIGS. 1–4. As shown in FIG. 1 the dry wipe board is designed to be wall mounted. In the open position as shown in FIG. 1, it is ready for use as a dry wipe marking board. In the closed position as shown in FIG. 2 it is designed to display a picture or painting.

Figure 4:
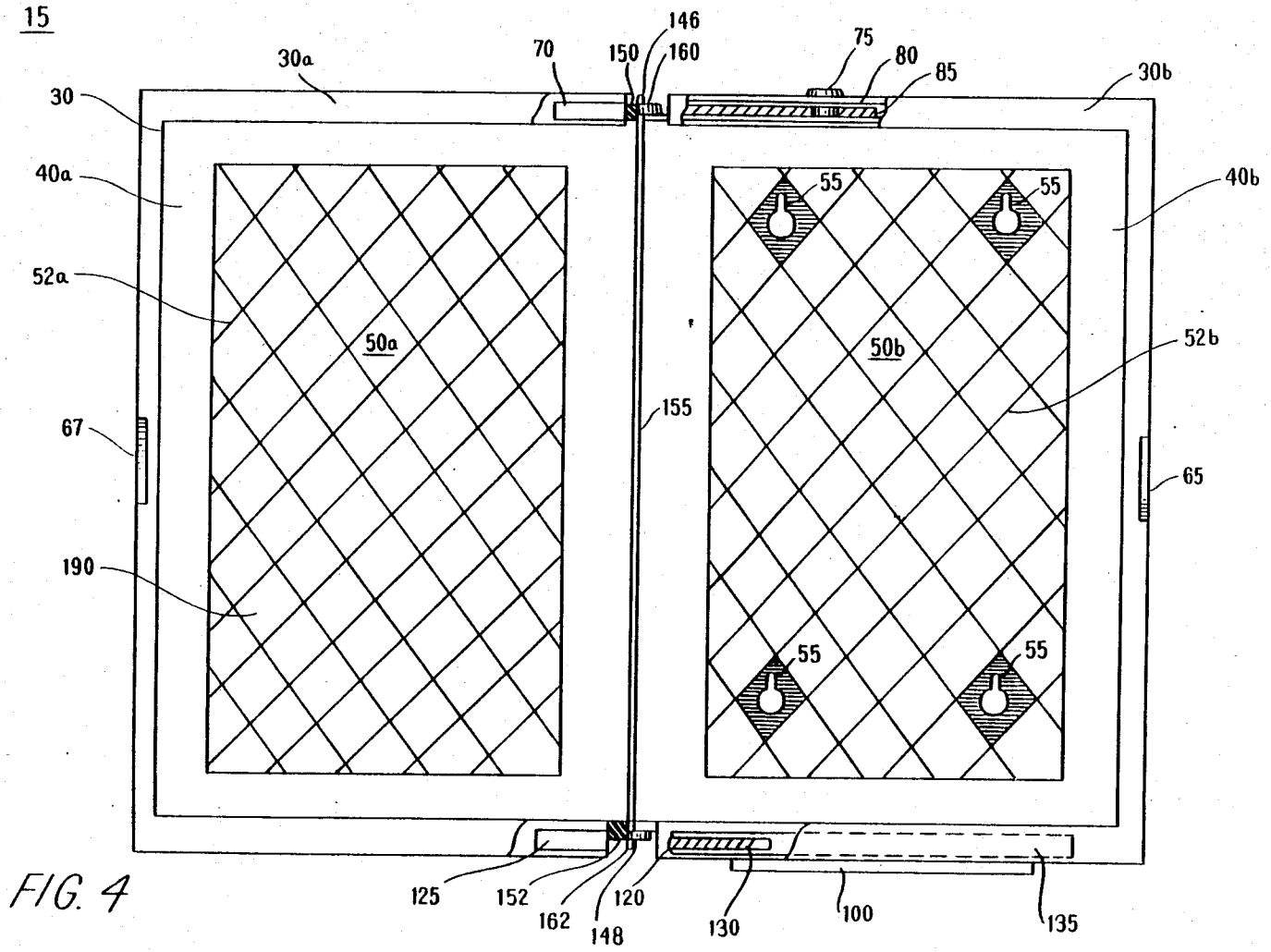
FIG. 4 is a plan view of the left and right support panels to which the writing panel is secured.

The convertible dry wipe board is composed of a support structure 15 as shown in FIG. 4 and a dry wipe writing panel 20 (FIG. 1) which is attached to the surface of support structure 15. Support structure 15 as best illustrated in FIG. 4 is composed of a left support panel 50*a* and a right support panel 50*b*. Each support panel 50*a* and 50*b* are separately molded and joined together at the upper and lower hinge connections 146 and 148 respectively. The right support panel 50*b* is composed of an outer frame 30*b*, an inner border 40*b* and a lattice web structure 52*b*. The right support panel 50*b* is formed by integrally molding the outer frame 30*b*, the inner border 40*b* and the lattice web structure 52*b* in a one step molding process, for example employing injection molding techniques or the equivalent. The one step molding of right support panel 50*b* thus avoids the need to fasten or glue the outer frame 30*b* to inner border 40*b* or the lattice structure 52*b* to inner frame 40*b*.

Outer border 30*b* is molded so as to provide a channel 80 at the top portion of the frame and similarily a channel 135 along the length of the bottom portion of the frame as shown in FIG. 4. A protruding locking flange 65 is also formed during the molding of right support panel 50*b*. It has been found preferable to employ a thermoplastic ABS (acrylonitrile-butadiene-styrene) resin for right support panel 50*b*. The lattice web 52*b* is integrally molded preferably of ABS resin as aforesaid to provide a lattice support structure of interlocking parallelograms, typically interlocking squares or rectangles as shown in FIG. 4.

The left support panel 50*a* is similarly composed of an outer frame 30*a* and an inner border 40*a* and a lattice web 52*a*. The left support panel 50*a* is made in a one step molding process in the same manner as support panel 50*b*. Thus, outer frame 30*a*, inner border 40*a* and the lattice web structure 52*a* are formed in a one step process by integrally molding suitable thermoplastic material such as ABS resin. An upper channel 70 located in the upper right hand corner of frame 30*a* is provided during the molding process. Similarily a channel 125 is provided in the lower right hand corner of frame 30*a* during the molding process. The position of channel 70 is adjacent to the upper hinge connection 146 and the position of channel 125 is adjacent the lower hinge connection 148 as best illustrated in FIG. 4. Frame 30*a* is molded to provide a depression 67 in frame 30*a* adapted to receive locking flange 65 of right support panel 50*b* when the support panel 50*a* is closed over panel 50*b*. On closure protruding member 65 fits snugly into depression 67 to hold the panels 50*a* and 50*b* in a closed position.

Right support panel 50*b* is also provided with a bottom tray 100 as illustrated in FIG. 1 and 4. The tray is attached separately to the bottom leg of outer frame 30*b* so as to provide a shelf for the writing marker and eraser as shown in FIG. 1. The back edge 130 of tray 100 is designed to fit into channel 135. As manual force is applied to either end of tray 100, the tray easily slides along the length of channel 135. Thus, when tray 100 is pushed from right to left, the back edge 130 will slide across hinged connection 148 and engage channel 125 of the left support panel 50*a*. Thus, back edge 130 functions as a locking bolt once it engages channel 125. Similarily, a bolt 85 is provided in channel 80 at the top portion of frame 30*b*. Bolt 85 may be manually slid across hinge connection 146 and into locking engagement with channel 70 of left support panel 50*a*. A lever 75 is connected to bolt 85 and protrudes from the top of frame 30*b*. When lever 75 is pushed horizontally to the left, bolt 85 slides across hinge connection 146 into receiving channel 70. Thus, when panel 50*a* and 50*b* are in the open position as shown in FIG. 4, these panels are locked in place by simply moving bolt 85 across hinged connection 146 into locking channel 70 and by sliding tray 100 and consequently bolt 130 across lower hinge connection 148 until it passes into locking channel 125. Once the upper locking bolt 85 is pushed into upper locking channel 70 and after locking bolt 130 is passed into lower locking channel 125 the support panels 50*a* and 50*b* become locked in the open position shown in FIG. 4.

Convertible dry wipe board 10 includes a dry wipe writing panel 20 which is superimposed over left and right support panels 50*a* and 50*b* respectively. The writing panel 20 is preferably a white smooth faced rigid polypropylene sheet having a thickness preferably of about 0.040 inches. It is important that the thickness of the white writing panel 20 be sufficient so that the sheet is rigid enough to provide a satisfactory writing surface, when it is secured to support panels 50*a* and 50*b*, but yet, not so thick as to add needlessly to the overall cost and weight. Applicant has determined that the thickness of the writing panel should be at least 0.020 inches, preferably between about 0.020 inches to about 0.060 inches. The lattice web structure 52*a* and 52*b* of support panels 50*a* and 50*b* respectively provide added support to the writing panel 20 to prevent buckling of the writing panel when the user writes on it. It has been determined that a lattice structure composed of parallelograms having sides of about 1 inch in length provide the necessary support for a polypropylene writing panel 20 having a thickness of at least 0.020 inches.

Dry wipe panel 20 is fabricated in conventional manner using a white pigmented polypropylene and is molded using conventional extrusion molding techniques. The preferred pigment is titanium dioxide. The preferred material polypropylene provides the required smooth writing surface demanded of a dry wipe board. The smooth surface enables the user to employ conventional dry wipe markers. These markers are known in the art and are available in the commercial market. One suitable dry wipe marker, for example, is available under the trademark EXPO dry erase marker sold by the Sanford Corp., Bellwood, Ill. These markers use solvent base ink which dries to a powder after it has been applied to a smooth plastic surface. The markers commonly come in different colors for example, red, blue, black and green. It has been determined that the a polypropylene surface, in particular a white pigmented polypropylene panel as above described forms a particularly suitable smooth white surface for receiving conventional solvent base inks used in conventional dry wipe markers. When the user writes on the writing panel 20 using conventional dry wipe markers, e.g., EXPO dry erase markers, the ink easily adheres to the polypropylene surface and can be applied in thick or thin strokes. The ink after it dries will adhere to the polypropylene surface for a considerably long time, for example, at least several months without significantly flaking or otherwise peeling away from the writing surface. The ink may be applied to the surface of polypropylene writing panel 20 even in fine lines. The dry wipe marker ink, e.g., EXPO dry wipe ink when applied to panel 20 readily dries to a powder and may be easily wiped away with a cloth or felt eraser. Tray 100 which is attached to lower frame 30*b* is provided to hold the dry wipe marker and eraser in proximity to the writing panel for the convenience of the user.

The writing panel 20 which is preferably formed of polypropylene has another important advantage. The preferred writing panel 20 composed of polypropylene has the property that it can be folded many thousands of times without tearing or distorting. Thus, the polypropylene writing panel 20 may be folded along a fold 155 which is substantially or nearly coincident with the hinge line between hinges 146 and 148 which separates the left support panel 50*a* from the right support panel 50*b*. The dry wipe board 10 of the invention may thus be converted from the open position shown in FIG. 1 to the closed position shown in FIG. 2 by first simply unlocking bolts 85 and 130 by sliding bolt 85 and tray 100, respectively, to the right. Then left support panel 50*a* is simply folded over right support panel 50*b* along fold line 155 to expose picture 190 and conceal writing panel 20. The polypropylene dry wipe writing panel 20 can be folded many thousands of times along line 155 without causing any tearing or deterioration in the writing panel along line 155. Thus, the writing panel 20 is said to have a living hinge along line 155. The living hinge is advantageously made by scoring the underside of writing panel 20 along the line 155. The thickness of the scored writing panel along line 155 should be preferably between about 0.015 to 0.020 inches to provide a suitable living hinge. This thickness has determined to be thin enough so that writing panel 20 can be folded easily along fold line 155 and yet thick enough so that the polypropylene material along line 155 can withstand many thousands of folds without showing any noticeable deterioration or tearing.

The convertible dry wipe board 10 of the invention when in the closed position as shown in FIG. 2 no longer displays the writing panel 20 but instead displays any desired picture or painting as shown in FIG. 2. The picture 190 which is displayed when the dry wipe board 10 is in the closed position (FIG. 2) is easily secured to the backside of the left support panel 50*a*. This is readily accomplished by utilizing a removable matte border 180 which may be made of rigid plastic or paper board material and which is designed to hold picture 190 in place on the back surface of left support panel 50*a*. The matte border 180 is designed to be removable from the picture frame 30 to enable the user to remove picture 190 and replace it with another picture or painting. The matte 180 may then be snapped in place over the new picture. The convertible dry wipe board 10 is readily hung on a wall surface using conventional picture hanging techniques. For example, back side of right support panel 50*b* may be provided with one or more hanging joints 55 integrally molded to the lattice web 52*b* of right support panel 50*b* as shown in FIG. 4. The convertible dry wipe board 10 may simply be hung on any interior wall by engaging a picture hook or bolt in each of the hanging joints 55. The left support panel 50*a* is not secured to the wall so that it can be freely folded along hinge line 155 when it is desired to close the dry wipe board and thus display picture 190 as shown in FIG. 2. When the dry wipe board 10 is closed, locking flange 65 engages and fits snugly into depression 67 to hold the panel in a closed position. When it is desired to use the dry wipe board, the user simply unlocks flange 65 and opens the left support panel 50*a* along fold line 155 until the left support panel 50*a* lies flush against the wall surface. After the upper locking bolt 85 and lower locking bolt 130 are engaged in their respective receiving channels 70 and 125 as aforementioned the dry wipe board 10 is ready for use with conventional dry wipe markers. The present invention thus has the unique feature of being a single unit conveniently convertible from a dry wipe writing panel to an attractive picture display without removing any panels or components from the hanging assembly 10.

It should be appreciated that the present invention may include more than two support panels and more than one fold in the writing panel. It should be realized also that the picture may be secured to the underside of the right support panel instead of the left, and the dry wipe board could then be closed from right to left. Also, the invention is not intended to be limited to the specific locking devices described for keeping the writing panel in a locked open position. The foregoing description is merely representative of a specific preferred embodiment of the invention and is not intended to limit the scope of equivalent structures or arrangements. Thus, the invention is not intended to be limited by the description in the specification but rather is defined by the claims and equivalents thereof.

What is claimed is:

1. A dry wipe writing board comprising:

a support structure being wall mountable;

a writing panel secured to the support structure, said writing panel having a smooth surface adapted for marking thereon with dry wipe marking ink;

the writing panel and support structure being foldable along nearly coincidental lines;

a picture area oriented on the backside of the support structure so that when the writing panel and support structure is folded the picture area becomes displayed in plain view and the writing panel becomes concealed and when the support structure is opened the writing panel becomes displayed in open view and the picture area becomes concealed, the support structure comprising two support panels joined together along a common hinge line, wherein each of said support panels comprises a lattice web structure and an outer border to which the lattice web is joined.

2. A dry wipe writing board as in claim 1 wherein each of the support panels is substantially flat.

3. A dry wipe board as in claim 1 wherein a dry wipe writing panel is secured to each of the support panels so that the backside of the writing panel lies against the lattice web of each of said support panels and the front side of the writing panel can be exposed for writing or marking thereon with dry wipe marking ink.

4. A dry wipe writing board as in claim 3 wherein the writing panel comprises polypropylene.

5. A dry wipe writing board as in claim 4 wherein the writing panel comprises polypropylene having a white pigment uniformly dispersed therein to give the writing panel a white appearance.

6. A dry wipe writing board as in claim 5 wherein the writing panel is foldable along a fold line therein so that when the support panels are opened along their hinge line the writing panel opens along its fold line to produce a flat writing surface having no discernible discontinuities thereon.

7. A dry wipe writing board as in claim 6 wherein one of the support panels is wall mountable so that the writing board can hang on a wall surface, and wherein the picture is secured to the backside of the other support panel so that when the writing board is hung on a wall surface and the support panels are closed along their hinge line, the writing panel folds along its fold line and becomes concealed, and the picture on said backside of said other support panel becomes displayed in plain view on the wall surface.

8. A dry wipe writing board as in claim 7 wherein the support panel to which said picture is secured includes means for holding the picture secured to the backside of said support panel, said means also being manually releaseable to allow replacement of said picture with a different picture.

9. A dry wipe writing board as in claim 7 wherein the thickness of the writing panel is at least 0.020 inches.

10. A dry wipe writing board as in claim 7 wherein the fold line in said writing panel is formed by scoring the backside of said writing panel in a line along its width nearly coincident with the hinge line connecting said support panels so that the thickness of the writing panel along said fold line is between about 0.015 to 0.020 inches, said writing panel exhibiting the property that it may be opened and closed along said fold line at least a thousand times without discernible tears appearing in the writing surface of said writing panel.

11. A dry wipe writing board as in claim 7 further comprising releasable locking means for keeping said support panels locked in the open position when it is desired to mark on said writing panel.

* * * * *